US005245149A

United States Patent [19]

Pinna et al.

[11] Patent Number: 5,245,149

[45] Date of Patent: Sep. 14, 1993

[54] PROCESS AND DEVICE FOR ACCELERATING THE DRYING OF CEMENT MIXES

[75] Inventors: Mario Pinna, Cagliari; Sergio Lai, Monserrato, both of Italy

[73] Assignee: Immobiliare Centro Nord S.p.A., S. Bonifacio, Italy

[21] Appl. No.: 717,777

[22] Filed: Jun. 17, 1991

[30] Foreign Application Priority Data

Jun. 21, 1990 [IT] Italy ..... 84965 A/90

[51] Int. Cl.[5] ..... H05B 6/80

[52] U.S. Cl. ..... 219/10.55 A; 219/10.55 F; 219/10.55 M; 219/10.55 R; 106/723; 34/10; 34/57 A; 404/77; 404/79; 264/122

[58] Field of Search ..... 219/10.55 A, 10.55 M, 219/10.55 F, 10.55 R; 106/730, 746, 750, 98; 366/1, 4, 7; 404/77, 79, 95; 34/10, 22, 57 A, 57 R; 264/122

[56] References Cited

U.S. PATENT DOCUMENTS 3,564,187 2/1971 Smith ..... 219/10.55 A
3,731,036 5/1973 Hallier et al. ..... 219/10.55 A
3,909,574 9/1975 Muller et al. ..... 219/10.55 A
4,338,135 7/1982 Cook ..... 106/97
4,370,534 1/1983 Brandon ..... 219/10.55 A
4,441,003 4/1984 Eves, II et al. ..... 219/10.55 A
4,908,486 3/1990 Fry ..... 219/10.55 A

OTHER PUBLICATIONS

Chemical Engineering vol. 89, No. 20, pp. 125-127.

*Primary Examiner*—Bruce A. Reynolds
*Assistant Examiner*—Tu Hoang
*Attorney, Agent, or Firm*—Puido Modiano; Albert Josif

[57] ABSTRACT

Process for the accelerated drying of cement mixes includes the application to the cement mixes of electromagnetic microwaves. The device for the accelerated drying of cement mixes includes a chamber in the form of a tunnel, defined by a supporting framework in which are accommodated cement mixes, preferably on a casting bed, and microwave generator, in the form of a plurality of magnetrons supported by vertically adjustable cross members. The magnetrons are provided with telescopingly adjustable waveguides having an outlet in the chamber, and the supporting framework is slidable on a track.

24 Claims, 3 Drawing Sheets

BEST AVAILABLE COPY

PROCESS AND DEVICE FOR ACCELERATING THE DRYING OF CEMENT MIXES

BACKGROUND OF THE INVENTION

The present invention relates to a process and device particularly for accelerating the drying or maintenance of cement mixes, such as prestressed and non-prestressed concrete components.

As is known, the curing or drying, i.e. the setting and hardening, of cement mixes or components, for example components cast on a casting bed, which can have a length of even 120 m and more, is performed and accelerated by heating with a conventional system which consists in causing a heating fluid, for example water or oil, to flow in a pipe arranged below the casting plane of the bed; said fluid yields heat by conduction and convection to the overlying component. The refinement of applying on the curing component one or more sheets of plastic material, in order to contain the heat and humidity of the concrete, is also already known.

Although this heating method is satisfactory when dealing with components having a height (thickness) of less than 40 cm, it yields insufficient results for thicker components. The temperatures, which are necessarily rather low in order to avoid burning the cement mix on the surface, and the presence of internal cavities for lightening the components in fact create hindrances to the conduction of heat, generating non-uniformities in the distribution of the temperatures and thus in the mechanical characteristics of the component.

Steam heating hoods are already used, but the are expensive and difficult to place and remove and most of all cause energy dispersions.

SUMMARY OF THE INVENTION

The aim of the present invention is to provide a new drying process and device which can be used universally to perform the drying of reinforced and non-reinforced cement mixes and mortars and even of the fiber-filled or loaded type used in the field of building.

An object of the present invention is to provide a microwave over which requires neither substantial modifications of cement production lines nor the use of highly specialized personnel for its operation.

Another object of the present invention is to provide a microwave capture system to ensure that the safety limits set by the currently applicable statutory provisions (1 to 5 $\mu W/cm^2$ at 5 cm from the unit or machine) are not exceeded in the surrounding environment.

According to a first aspect of the present invention, an accelerated drying process for cement mixes is provided which comprises the application, in said mixes, of heat caused by irradiation with microwaves.

According to another aspect of the present invention, a device in the form of a microwave over for the execution of the above drying process is provided which comprises a supporting structure which delimits, inside it, a chamber or tunnel for accommodating at least one fresh cement product, at least one source of electromagnetic microwaves which is supported by said supporting structure and is suitable for irradiating microwaves toward the accommodation chamber, and shielding means suitable for preventing the escape of microwaves from the accommodation chamber.

BRIEF DESCRIPTION OF THE DRAWINGS

Further aspects and advantages of the invention will become apparent from the following detailed description of a currently preferred, but not exclusive, embodiment thereof, given only by way of non-limitative example, with reference to the accompanying drawings, wherein.

DESCRIPTION OF THE PREFERRED EMBODIMENTS

Figure 1:
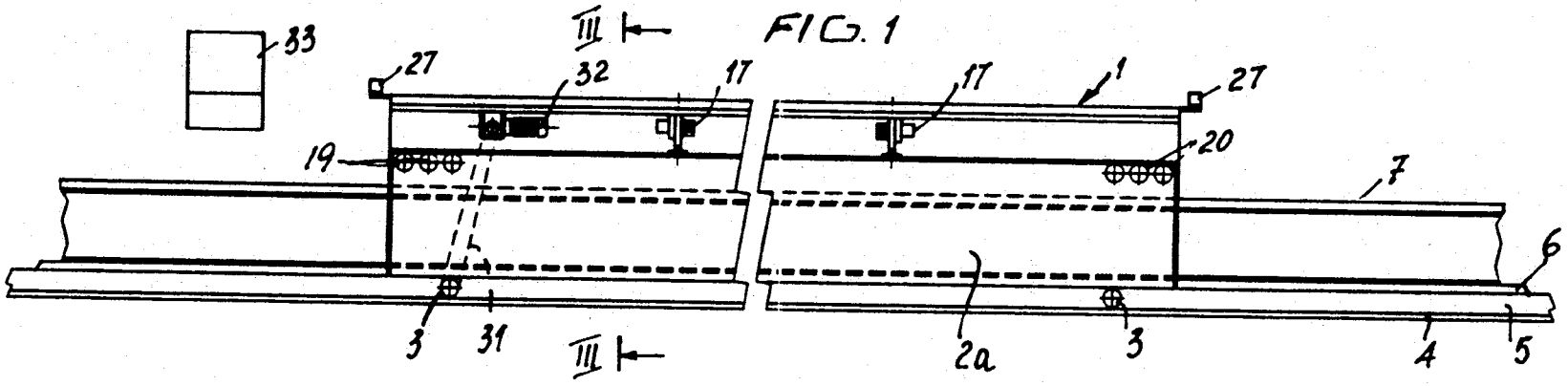
FIG. 1 is a lateral elevation view of an industrial microwave over which is mounted so as to be movable along and around a casting bed on which a component is cast and is drying.
Figure 2:
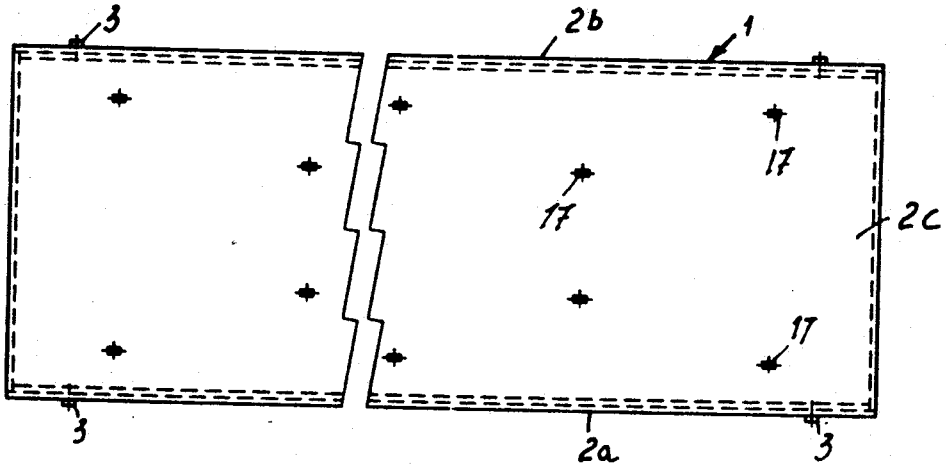
FIG. 2 is a plan view of the microwave over of FIG. 1.

With reference to the above FIGURES, a movable microwave oven, generally indicated by the reference numeral 1, is formed by a supporting framework 2 which is mounted on wheels 3 which can slide on a track 4 which extends parallel to, and has the same extension as, the sides of a fixed or movable casting bed 5 which comprises, for example, a casting plane formed by a movable plate 6 which for example has a length of 120 m or more and is 1.0 to 2.5 m wide. One or more concrete components 7, cast in the absence of formwork, for example by using a per se known vibratory finishing machine, and in the process of being dried, for example a concrete casting hypervibrated on prestressed steel reinforcement rods to obtain prestressed concrete parts or components, are placed on the casting bed 5.

The framework 2 can have two lateral containment walls **2*a* and 2*b* which are connected in a bridge-like manner by a "ceiling" or transverse top wall 2*c*, so as to delimit a tunnel 8 which is suitable for constituting an opening for the passage, through it, of one or more casting beds 5 which are arranged end to end and are provided thereupon with a respective component or components 7 to be dried. The walls 2*a*, 2*b* and 2*c*** can comprise a stainless steel sheilding plate (stainless steel is preferred since it is non-magnetizable, does not heat and provides a better efficiency of the oven).

Figure 3:
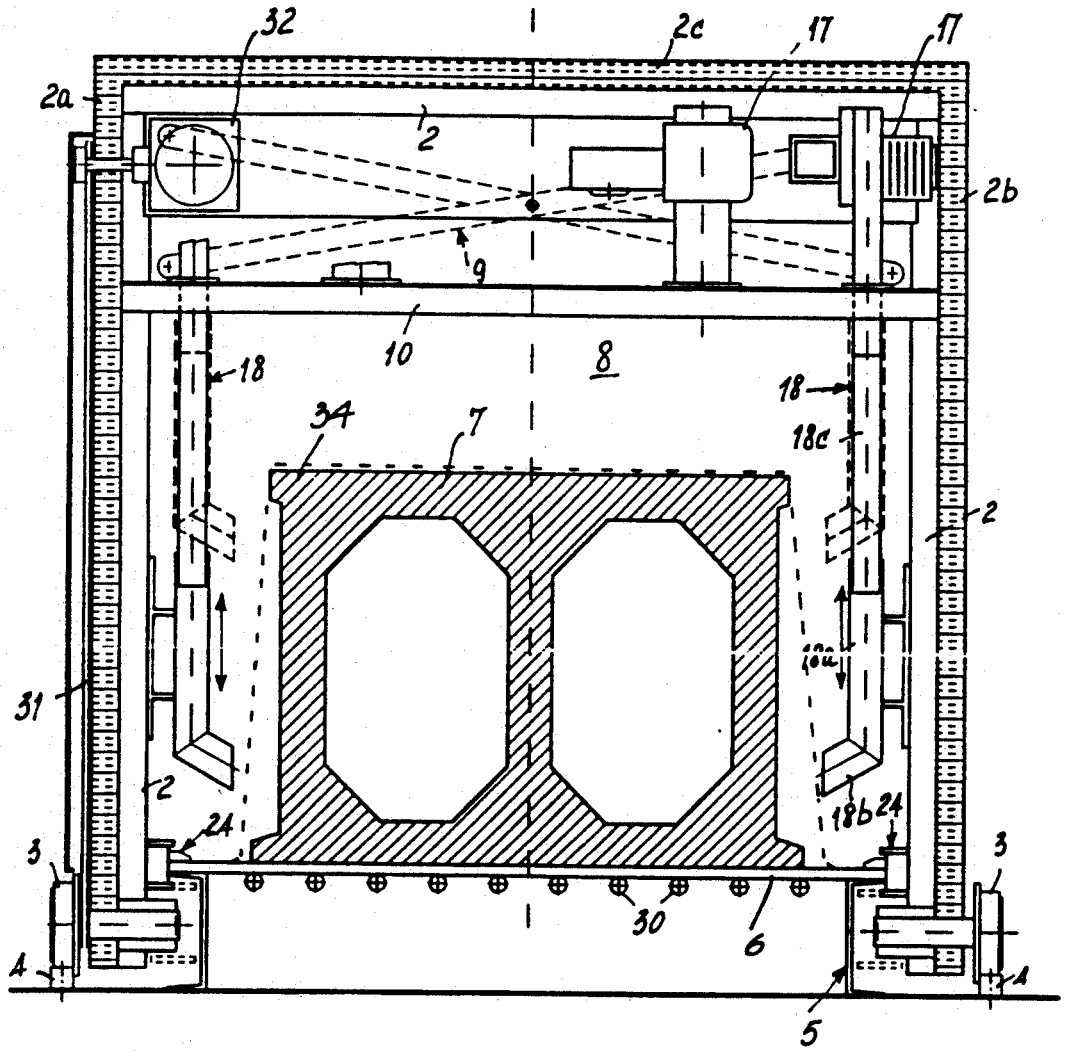
FIG. 3 is a transverse sectional enlarged-scale view, taken along the line III—III of FIG. 1.
Figure 6:
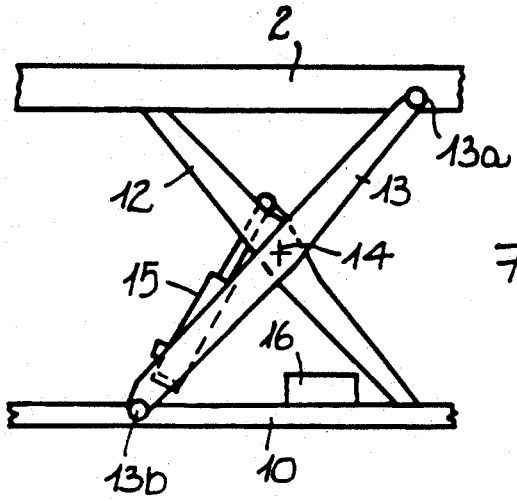
FIG. 6 is a view of a device for lifting-lowering the ceiling of the oven of FIGS. 1 to 3.

A lifting device 9 (FIGS. 3 and 6) is accommodated directly below the top wall **2*c*, is supported by the framework 2, for example hung below the top wall 2*c*, and is intended to raise and lower one or more cross-members 10**, as will be explained hereinafter.

Said lifting device 9 can comprise one or more pairs of arms 12 and 13 which are mutually articulated at their centerline, at 14, about a horizontal axis and have their ends pivoted, for example, respectively at **13*a* and 13*b*, to the supporting framework 2 and to the cross-member or cross-members 10**.

The arms 12 and 13 can be actuated in a pantograph-like manner by actuation means, constituted for example by a fluid dynamic unit 15 with cylinder and piston, which can be driven by an electric-hydraulic control unit 16.

Beneath the ceiling of the tunnel, the supporting framework 2 supports a plurality of microwave generators or magnetrons 17, which have a vertical waveguide 18; said waveguide preferably has a lower portion 18*a*, which is fixed to the framework 2 and has an end 18*b* directed toward the inside, i.e. toward the component 7, and an upper portion 18*c*, which is telescopically connected to the lower portion 18*a*.

Figure 5:
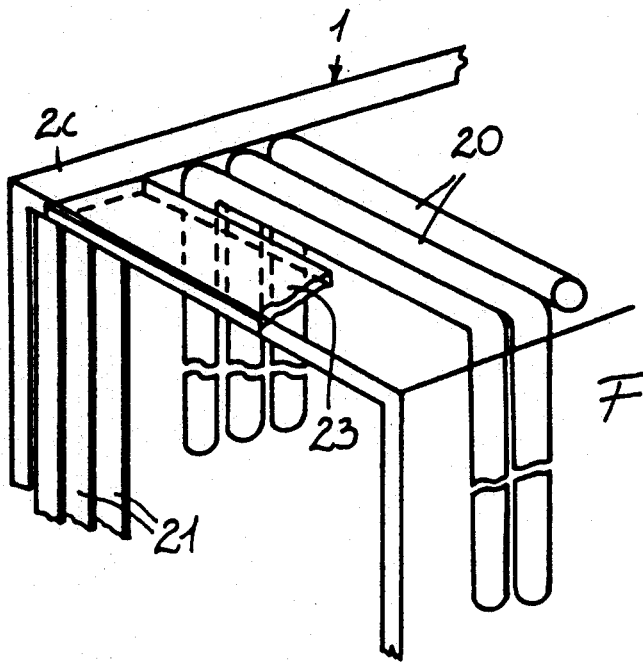
FIG. 5 is a schematic perspective view of microwave barriers and traps which can be adopted in the oven of FIGS. 1 to 3.

At its front and rear ends, the oven 1 has a barrier or capture trap means 19 and 20 for microwaves, which comprise for example a plurality of tubes which are made of a material (FIG. 5) which is transparent to electromagnetic waves, such as polycarbonate, toughened glass; said tubes are filled with water and line the ceiling at the sides of the tunnel 18 until they reach proximate to labyrinths 24 which will be described hereinafter. Each capture trap can also comprise a plurality of suspended fins 21, which are mutually aligned so as to cover the entry and exit openings of the tunnel, and one or more panels 23 made of absorbing material, for example a spongy material based on rubber and graphite. Each of the fins 21 can be constituted by a lamina or strip of rubber with an inner surface (the one directed toward the tunnel 8) coated with a metallic paint which reflects microwaves; during use, said fins are intended to slide against the component 7. For this purpose, some of them, the central ones, can have a reduced height in order to adapt to the cross-section of the component 7.

Figure 4:
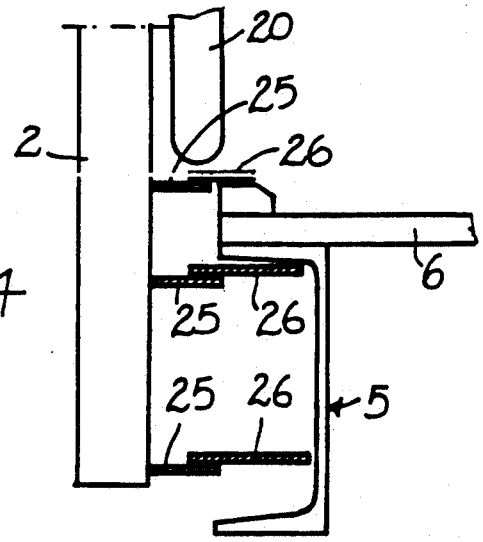
FIG. 4 is a view of a detail related to a labyrinth for containing the electromagnetic field provided in the oven of FIG. 3.

Two labyrinths 24 for containing the electromagnetic field (FIGS. 3 and 4) are provided between the plate 6 and the lateral walls 2*a* and 2*b* at the low part of the tunnel 8, proximate to the tracks 4; each labyrinth comprises for example three superimposed series, each composed of two metallic profiled longitudinal plate elements 25 and 26; said profiled element 25 is fixed, for example welded, in a cantilevered manner, to the framework 2, and the profiled element 26 is supported by the respective profiled element 25, preferably so that it can be adjusted, in contact therewith but at a variable distance therefrom, so as to be able to create a safe microwave cutoff barrier.

I required, for greater safety, it is possible to install, at the ends of the oven 1, external electromagnetic field detectors 27 and 28, set for example to detect the maximum value allowed by the applicable statutory provisions, beyond which they emit alarm signals which cause the halting of the oven.

As can be seen, the casting bed 5 can have, below its own movable casting plane 6, a system of pipes or coils 30, for example of a conventional type, for the flow of a heating convection fluid, such as water or oil, for heating the plate 6 so as to contribute to the heating action of the oven 1.

The movable microwave oven 1 is intended to perform one or more strokes, possibly in a back-and-forth manner, along the casting bed 5 in order to heat the component or components 7. For this purpose, at least one of the wheels 3 is a driving wheel, since it is kinematically connected, for example by means of a chain transmission 31 (FIGS. 1 and 3), to a gearmotor unit 32 supported by the framework 2 at the top of the tunnel 8. The gearmotor 32 can receive electric current from a bus-duct or cable current supply and can be controlled by an inverter (not illustrated in the drawings) which allows to vary the speed according to the timings required for each type of component, the initial acceleration and the final deceleration, and to perform motion reversal, possibly for a stroke with a normal pass and a rapid return to order to uniformly treat the component along its entire length.

This arrangement allows the tunnel 8 to constitute a multiresonating chamber which allows multimode irradiation of the electromagnetic field with the microwave generators 17 and an irradiation, orientated and tailored according to the shape and dimensions of the component 7, with the waveguides 18. Each microwave generator 17 can be provided with power adjustment, for example up to 1200–1960 watts or more, to allow metered irradiation in each region of the tunnel or chamber 8 so as to balance the temperatures in the treated component, this ensuring the obtainment of a dried component with uniform mechanical characteristics along its entire length.

The possibility of lifting-lowering the microwave generators 17 within the resonating chamber 8, by virtue of the action of the device 9 on the cross-member or cross-members 10, allows to increase its efficiency, since it is possible to relate the operative dimensions of said chamber to those of the component 7, so as to obtain an optimum ratio between the volume of the chamber and the volume of the component 7.

A computer, equipped with PLCs controlled by it and generally indicated by the reference numeral 33 in FIG. 1, can be assigned to perform the program-based control of the rotation rate of the gearmotor or gearmotors 32 and thus of the translatory speed of the oven 1, of the power of each microwave generator 17, of the switching on and off and of the active times of said generators, of the temperature of the chamber 8 and of the surface temperatures of the component 7.

The above described microwave oven 1 can normally be kept idle on the tracks 4 beyond one end of the casting plane 5. Once the component or components 7 have been cast, the "accelerated drying" treatment according to the invention is started. According to a preset cyclic program, the computer 33 actuates all the various components of the oven, checks the exact values of the set parameters and starts the translatory motion of the oven along the rails 4. The oven can travel, for example, at a speed of 6–60 m/min with a computer-set power of the microwave generators 17.

However, it is also possible to provide different energy deliveries, for example an active pass is performed with a fast inactive return so as to start one or more subsequent active passes, for example 6–15 times, so as to subject the entire component or components 7 to a uniform treatment.

At the end of the treatment according to the preset program, the oven 1 places itself on standby at its idle position. During the movements of the oven above the component 7, the strips or laminas 21 at the end of the tunnel skim and slide to a certain extend against the component and reflect toward the inside of the oven any microwaves directed onto them. The same shielding effect is ensured by the profiled longitudinal plate elements 25, 26 of the layrinths 24, whereas an absorbing and damping effect is exerted on the microwaves leaving the chamber 8 both by the hydraulic barrier 20 and by the panel or panels made of absorbing material 23.

The microwave treatment performed by the oven 1, in a first step, induces a progressive heating of the component, until a temperature of approximately 80° C. is reached; in a second step, the temperature of the component 7 is kept constant on the average (around 70–80° C.) between the successive active passes of the oven but is returned to 80° C. or more at each active pass of said oven; and provides, in a final step, a natural and/or controlled cooling of the cement mix.

According to the dimensions and geometry of the component or components 7, a complete cycle of "accelerated curing" according to the invention can require only an amount of time comprises between approximately 1 and 5 hours with respect to a curing time of at least 5–10 hours according to the more widespread conventional hot-curing processes.

As mentioned above, the length of the oven and its translatory speed are a function both of the irradiation power of the microwave generators 17 and of the temperature which must be reached inside the component or components 7, as well as of the volumetric characteristics of said component. Thus, for example, with a casting bed 120 m long and with a component 7 approximately one meter high, each component segment can be irradiated with microwaves every 10–15 minutes.

A movable microwave oven such as the one described above can naturally be used not only for drying prestressed components cast on a casting bed but also for the drying of mixes in formworks, other prefabricated reinforced-concrete components, such as pillars, beams, piles, floors, load-bearing partition walls, facade panels, non-load-bearing panels for internal partitions, flights of stairs and landings, fume vent stacks, pipes, tiles, slabs, floor tiles, paving tiles, wells, curbstones, brackets, benches, pipelines, perforated or solid blocks, tanks and the like.

Naturally, it is not possible to use ordinary metallic formworks, since they would deflect the electromagnetic field generated by the microwave generators, fully shielding the component. It is necessary to use formworks made of a dielectric material, such as plastic, wood, etc., which is transparent to microwaves.

The frequencies for industrially usable microwaves, according to international standards, are approximately 915, 2450 and 5800 MHz.

The oven can be provided with a unit (not illustrated in the drawings) for rolling/unrolling a sheet of flexible plastic material 34 (FIG. 3) to be applied on the component 7 to contain the heat and humidity developed by the curing component.

From practical tests it has been found that the mechanical strength of components dried with the process and with an oven according to the invention is substantially equal to that of specimen comparison components dried with convention procedures.

Some test results are listed in the following table.

SUMMARY TABLE OF SOME TESTS WITH MICROWAVE IRRADIATION

Times indicated in minutes: min
Temperatures in °C.: t. °C.
Microwave irradiation: MW irr/min
Cubic comparison strength: Comp. in kg/cm²

| | MICROWAVE DRYING | | | | | NATURAL DRYING | |
|---|---|---|---|---|---|---|---|
| | Treatment times | | | Cubic strength | | Comp. cubic strength | |
| Test Nr. | Total min. | MW irr/ min. | t. °C. | after Nr. of days | kg/cm² | after Nr. of days | kg/cm² |
| 1 | 180 | 24 | 80 | 1 | 370 | 1 | 260 |
| | | | | 3 | 410 | 3 | 360 |
| | | | | 7 | 460 | 7 | 430 |
| | | | | 28 | 510 | 28 | 560 |
| 2 | 240 | 35 | 80 | 1 | 430 | 1 | 220 |
| | | | | 3 | 450 | 3 | 400 |
| | | | | 7 | 465 | 7 | 450 |
| | | | | 28 | 540 | 28 | 580 |
| 3 | 210 | 30 | 80 | 1 | 340 | 1 | 190 |
| | | | | 3 | 375 | 3 | 330 |
| | | | | 7 | 410 | 7 | 450 |
| | | | | 28 | 515 | 28 | 570 |

We claim:

1. Device for curing cement mixes comprising;
a substantially horizontal elongate casting bed for supporting a cast component;
tunnel means overlying a portion of said casting bed;
drive means connected to said tunnel means for causing relative movement in a longitudinal direction between said tunnel means and said casting bed;
a plurality of magnetrons connected to said tunnel means, and;
a waveguide connected to each of said magnetrons and being movable with respect to said tunnel means;
whereby each said waveguide is orientable with respect to a component cast on said casting bed for optimizing electromagnetic energy distribution according to shape and configuration of said component.

2. Device according to claim 1, wherein said tunnel means comprise;
a supporting framework including two lateral containment walls;
a transverse top wall interconnecting said lateral containment walls;
a cross member located beneath said transverse top wall, said cross member supporting said magnetrons and extending between said lateral containment walls, and;
lifting device for moving said cross member towards and away from said transverse top wall, whereby to dimensionally optimize said tunnel according to shape and configuration of a component cast on said casting bed.

3. Device according to claim 2, wherein said tunnel means further comprise microwave closure trap means, said microwave closure trap means extending transversely between said lateral containment walls beneath said cross member.

4. Device according to claim 1, wherein each said waveguide is independently movable with respect to said tunnel means in a direction perpendicular to said longitudinal direction.

5. Device according to claim 2, wherein said lifting device comprises;
a pantograph mechanism interconnecting said cross member and said transverse top wall;
fluid dynamic actuation means connected to said pantograph mechanism, and;
an electric-hydraulic control unit for driving said fluid dynamic actuation means.

6. Device according to claim 1, wherein each said movable waveguide comprising an upper waveguide portion and a lower waveguide portion, said upper waveguide portion being connected to one of said plurality of magnetrons and telescopically connected to said lower waveguide portion.

7. Device according to claim 4, wherein each said movable waveguide comprises an upper waveguide portion and a lower waveguide portion, said upper waveguide portion being connected to one of said plurality of magnetrons and telescopically connected to said lower waveguide portion, and wherein said lower waveguide portion has a waveguide end, said waveguide end being orientable towards a cast component supported on said casting bed.

8. Device according to claim 3, wherein said microwave closure trap means comprise a plurality of water-filled tubes, said tubes being made of a material selected from a group consisting of polycarbonate and toughened glass.

9. Device according to claim 3, wherein said microwave closure trap means comprise a plurality of mutually aligned fins, said fins each having an inner surface and being adapted for sliding contact engagement with a cast component supported on said casting bed, said inner surface of each of said fins having a microwave reflecting coating.

10. Device according to claim 2, further comprising tracks extending parallel to said casting bed, at opposite sides thereof;

wheels rotably supporting said supporting framework on said tracks, and;

motor means connected to said framework and driving at least one of said wheels, whereby to move said tunnel means, said plurality of magnetrons, and each said movable waveguide with respect to a component cast on said casting bed.

11. Device according to claim 1, further comprising labyrinth means for containing electromagnetic energy, said labyrinth means being located proximate to said tracks and comprising a plurality of vertically superimposed profiled longitudinal plate elements, said plurality of vertically superimposed profiled longitudinal plate elements being connected to said framework and including plate elements located below said casting plane.

12. Device for curing cement mixes comprising;

substantially horizontal elongate casting bed for supporting a cast component;

a tunnel overlying a portion of said casting bed;

drive means connected to said tunnel for moving said tunnel with respect to said casting bed in a longitudinal direction;

a plurality of magnetrons connected to said tunnel, and;

a waveguide connected to each of said magnetrons and being movable with respect to said tunnel;

whereby each said waveguide is orientable with respect to a component cast on said casting bed for optimizing electromagnetic energy distribution according to shape and configuration of said component, and, wherein said tunnel comprises;

a supporting framework including two lateral containment walls;

a transverse top wall interconnecting said lateral containment walls;

a cross member located beneath said transverse top wall, said cross member supporting said magnetrons and extending between said lateral containment walls, and;

means for moving said cross member towards and away from said transverse top wall, whereby to dimensionally optimize said tunnel according to shape and configuration of a component cast on said casting bed.

13. Device according to claim 12, wherein said tunnel further comprises microwave closure traps, said microwave closure traps extending transversely between said lateral containment walls beneath said cross member.

14. Device according to claim 12, wherein each said waveguide is independently movable with respect to said tunnel in a direction perpendicular to said longitudinal direction.

15. Device according to claim 12, wherein said lifting means comprise;

a pantograph mechanism interconnecting said cross member and said transverse top wall;

fluid dynamic actuation means connected to said pantograph mechanism, and;

an electric-hydraulic control unit for driving said fluid dynamic actuation means.

16. Device according to claim 12, wherein each said movable waveguide comprises an upper waveguide portion and a lower waveguide portion, said upper waveguide portion being connected to one of said plurality of magnetrons and telescopically connected to said lower waveguide portion.

17. Device according to claim 14, wherein each said movable waveguide comprising an upper waveguide portion and a lower waveguide portion, said upper waveguide portion being connected to one of said plurality of magnetrons and telecopically connected to said lower waveguide portion, and wherein said lower waveguide portion has a waveguide end, said waveguide end being oriented towards said casting bed for directing electromagnetic energy towards a cast component supported on said casting bed.

18. Device according to claim 12, further comprising tracks extending parallel to said casting bed, at opposite sides thereof;

wheels rotatably supporting said supporting framework on said tracks, and;

motor means connected to said framework and driving at least one of these wheels, whereby to move said tunnel, said plurality of magnetrons, and each said movable waveguide with respect to a component cast on said casting bed.

19. Device according to claim 13, further comprising labyrinths for containing electromagnetic energy, said labyrinths being located proximate to said tracks and comprising a plurality of vertically superimposed longitudinal plate elements, said plurality of vertically superimposed longitudinal plate elements being connected to said framework and including plate elements lying above said casting plane and plate elements lying below said casting plane.

20. Device for curing cement mixes comprising;

substantially horizontal elongate casting bed for supporting a cast component;

a tunnel overlying a portion of said casting bed;

drive means connected to said tunnel for moving said tunnel with respect to said casting bed in a longitudinal direction;

a plurality of magnetrons connected to said tunnel;

a waveguide connected to each of said magnetrons and being movable with respect to said tunnel;

whereby each said waveguide is orientable with respect to a component cast on said casting bed for optimizing electromagnetic energy distribution according to shape and configuration of said component, and, wherein said tunnel comprises;

a supporting framework including two lateral containment walls;

a transverse top wall interconnecting said lateral containment walls;

a cross member located beneath said transverse top wall, said cross member supporting said magnetrons and extending between said lateral containment walls, and;

means for moving said cross member towards and away from said transverse top wall, whereby to dimensionally optimize said tunnel according to shape and configuration of a component cast on said casting bed, said device further comprising;

tracks extending parallel to said casting bed, at opposite sides thereof;

wheels rotatably supporting said supporting framework on said tracks;

motor means connected to said framework and driving at least one of said wheels, whereby to move said tunnel, said plurality of magnetrons, and each said movable waveguide with respect to a component cast on said casting bed;

microwave closure traps extending transversely between said lateral containment walls beneath said cross member, and;

labyrinths for containing electromagnetic energy located proximate to said tracks.

21. Device according to claim 20, wherein each said waveguide is independently movable with respect to said tunnel in a direction perpendicular to said longitudinal direction.

22. Device according to claim 20, wherein said lifting means comprises;

a pantograph mechanism interconnecting said cross member and said transverse top wall;

fluid dynamic actuation means connected to said pantograph mechanism, and;

an electric-hydraulic control unit for driving said fluid dynamic actuation means.

23. Device according to claim 20, wherein each said movable waveguide comprises an upper waveguide portion and a lower waveguide portion, said upper waveguide portion being connected to one of said plurality of magnetrons and telescopically connected to said lower waveguide portion.

24. Device according to claim 21, wherein each said movable waveguide comprising an upper waveguide portion and a lower waveguide portion, said upper waveguide portion being connected to one of said plurality of magnetrons and telescopically connected to said lower waveguide portion, and wherein said lower waveguide portion has a waveguide end, said waveguide end being oriented towards said casting bed for directing electromagnetic energy towards a cast component supported on said casting bed.

* * * * *